US006647584B2

(12) United States Patent
Pileggi

(10) Patent No.: US 6,647,584 B2
(45) Date of Patent: Nov. 18, 2003

(54) CLEANING APPARATUS USING VAPORMIST SPRAY

(76) Inventor: Eugene J. Pileggi, 8 Summit View Dr., Bayville, NY (US) 11709

( * ) Notice: Subject to any disclaimer, the term of this patent is extended or adjusted under 35 U.S.C. 154(b) by 3 days.

(21) Appl. No.: 09/998,717

(22) Filed: Oct. 24, 2001

(65) Prior Publication Data

US 2002/0056170 A1 May 16, 2002

Related U.S. Application Data

(60) Provisional application No. 60/248,360, filed on Nov. 14, 2000.

(51) Int. Cl.[7] ..... A47L 9/00

(52) U.S. Cl. ..... 15/321; 15/322; 239/369

(58) Field of Search ..... 15/320, 321, 322; 239/754, 369, 346, 352, 364, 365, 366, 368, 418, 351

(56) References Cited

U.S. PATENT DOCUMENTS

| | | | | | |
|---|---|---|---|---|---|
| 2,931,580 | A | * | 4/1960 | Johnson | 239/346 |
| 3,931,662 | A | | 1/1976 | Nayfa et al. | 15/320 |
| 4,000,536 | A | | 1/1977 | Nayfa et al. | 15/50.2 |
| 4,041,568 | A | | 8/1977 | Rhodes | 15/344 |
| 4,146,944 | A | * | 4/1979 | Pinto | 15/321 |
| 4,167,799 | A | | 9/1979 | Webb | 15/320 |
| 4,300,261 | A | | 11/1981 | Woodward et al. | 15/345 |
| 4,315,344 | A | | 2/1982 | Woodward et al. | 15/345 |
| 4,329,756 | A | * | 5/1982 | Chicoine et al. | 15/321 |
| 5,485,651 | A | | 1/1996 | Payeur | 15/321 |
| 5,713,519 | A | * | 2/1998 | Sandison et al. | 239/369 |
| 5,891,198 | A | * | 4/1999 | Pearlstein | 15/322 |
| 6,276,613 | B1 | * | 8/2001 | Kramer | 15/320 |

* cited by examiner

*Primary Examiner*—Theresa T. Snider
(74) *Attorney, Agent, or Firm*—Gerald T. Bodner

(57) ABSTRACT

An apparatus for cleaning an object surface generally includes a junction, a holding tank for containing a cleaning solution therein and a compressor in fluid communication with the holding tank. The holding tank is in fluid communication with a first inlet of the junction and the compressor is in fluid communication with a second inlet of the junction. The compressor supplies an amount of compressed air to the holding tank to create a positive pressure in the tank thereby forcing an amount of cleaning solution out of the tank into the first inlet of the junction. The compressor also supplies an amount of compressed air to the second inlet of the junction where it is combined with the cleaning solution supplied at the first inlet of the junction to produce an atomized mist discharged from an outlet of the junction.

17 Claims, 4 Drawing Sheets

CLEANING APPARATUS USING VAPORMIST SPRAY

CROSS-REFERENCE TO RELATED APPLICATIONS

This application claims the benefit of U.S. Provisional Application No. 60/248,360, filed Nov. 14, 2000.

BACKGROUND OF THE INVENTION

1. Field of the Invention

The present invention relates to an apparatus for cleaning an object surface. More particularly, the present invention relates to an apparatus for cleaning an object surface, which mixes compressed air and a cleaning solution in a manner which atomizes the cleaning solution and delivers the cleaning solution to the object surface to be cleaned.

2. Description of the Prior Art

Ordinarily, when an individual wishes to clean a floor, they fill a pail with water and a cleaning solution and apply the resultant water/cleaning solution mixture to the floor with a mop. This procedure, however, is terribly inefficient and does not effectively clean the floor. In fact, this method of cleaning typically renders the floor less clean than before the mopping. This is because the individual doing the mopping will repeatedly rinse the dirty mop in the same water/cleaning solution pail. Each time the individual rinses the mop in the pail they just spread the dirty water/cleaning solution onto the floor. Further, this method of cleaning typically leaves a significant amount of water on the floor, thereby making the mopped surface slippery and, therefore, dangerous to persons walking thereupon. Also, this method requires a significant amount of time for the surface to thoroughly dry, or requires a separate drying step to be performed.

Other spray and extract equipment now in use are required to produce a great deal of water volume on the order of 1–3 gallons per minute and water pressures on the order of 50–250 psi to enable the standard spray nozzle to function (proper spray pattern). Furthermore, this method of cleaning typically leaves a significant amount of water on the floor, thereby making the surface slippery and dangerous to persons walking thereupon. Also, this method requires a significant amount of time and labor to thoroughly dry the surface.

In other situations, such as when an individual wishes to clean equipment, the user washes the equipment by using a standard garden hose or a hand pumped or powered pressure sprayer. This not only floods the area around the equipment with water, but also may be impractical if the equipment is located in an area which can not be flooded. Further, this method of cleaning typically uses more water than that actually required to satisfactorily clean the equipment. Similar to the mop and pail method, this method also requires a significant amount of time for the equipment to dry, or requires a separate drying step to be performed.

Therefore, there remains the need for a cleaning apparatus which can deliver a cleaning solution to a surface to be cleaned without delivering too much or too little cleaning solution.

OBJECTS AND SUMMARY OF THE INVENTION

An object of the present invention is to provide a cleaning apparatus which is capable of delivering an atomized cleaning solution to an object surface to be cleaned.

Another object of the present invention is to provide a cleaning apparatus which allows adjustment for the amount of cleaning solution delivered to the object surface to be cleaned.

A further object of the present invention is to provide a cleaning apparatus, which is capable of removing the cleaning solution from the object surface after it has been delivered thereto by a built-in vacuum system.

In accordance with the present invention, an apparatus for cleaning an object surface is provided. The apparatus generally includes a junction, a holding tank for containing a cleaning solution therein and a compressor in fluid communication with the holding tank. The holding tank is in fluid communication with a first inlet of the junction and the compressor is also in fluid communication with a second inlet of the junction. The compressor supplies an amount of compressed air to the holding tank to create a positive pressure in the tank thereby forcing an amount of cleaning solution out of the tank into the first inlet of the junction. The compressor also supplies an amount of compressed air to the second inlet of the junction where it is combined with the cleaning solution supplied at the first inlet of the junction to produce an atomized mist discharged from an outlet of the junction without the need for any added special apparatus (i.e., a pump) to develop the atomized mist.

The apparatus further preferably includes a vacuum unit producing a suction at the junction outlet and a restrictor valve for adjusting the amount of cleaning solution supplied by the holding tank to the first inlet of the junction. The restrictor valve preferably allows for varying the amount of cleaning solution supplied by the holding tank from about 5 gallons per minute to about 0.015 gallons per minute, which produces a vapor-mist spray without the need for additional apparatus that is needed in all other "misting" equipment in use today.

In the preferred embodiment, a standard nozzle is provided at the outlet of the junction for discharging the atomized cleaning solution onto the object surface to be cleaned and for removing the atomized cleaning solution from the object surface to the vacuum unit. The nozzle preferably includes a first port in fluid communication with the outlet of the junction for discharging the atomized cleaning solution and a second port in fluid communication with the vacuum unit for removing the discharged cleaning solution into the vacuum unit.

In an alternative embodiment, the apparatus includes a pump for supplying the amount of cleaning solution to the first inlet of the junction. In this embodiment, the compressor merely supplies compressed air to the second inlet of the junction where it is combined with the cleaning solution supplied by the pump so as to atomize the cleaning solution. The atomized cleaning solution is then discharged from the outlet of the junction onto the object surface to be cleaned.

For a better understanding of the present invention, reference is made to the following detailed description to be read in conjunction with the accompanying drawings and its scope will be to find in the appended claims.

DETAILED DESCRIPTION OF THE PREFERRED EMBODIMENTS

Figure 1:
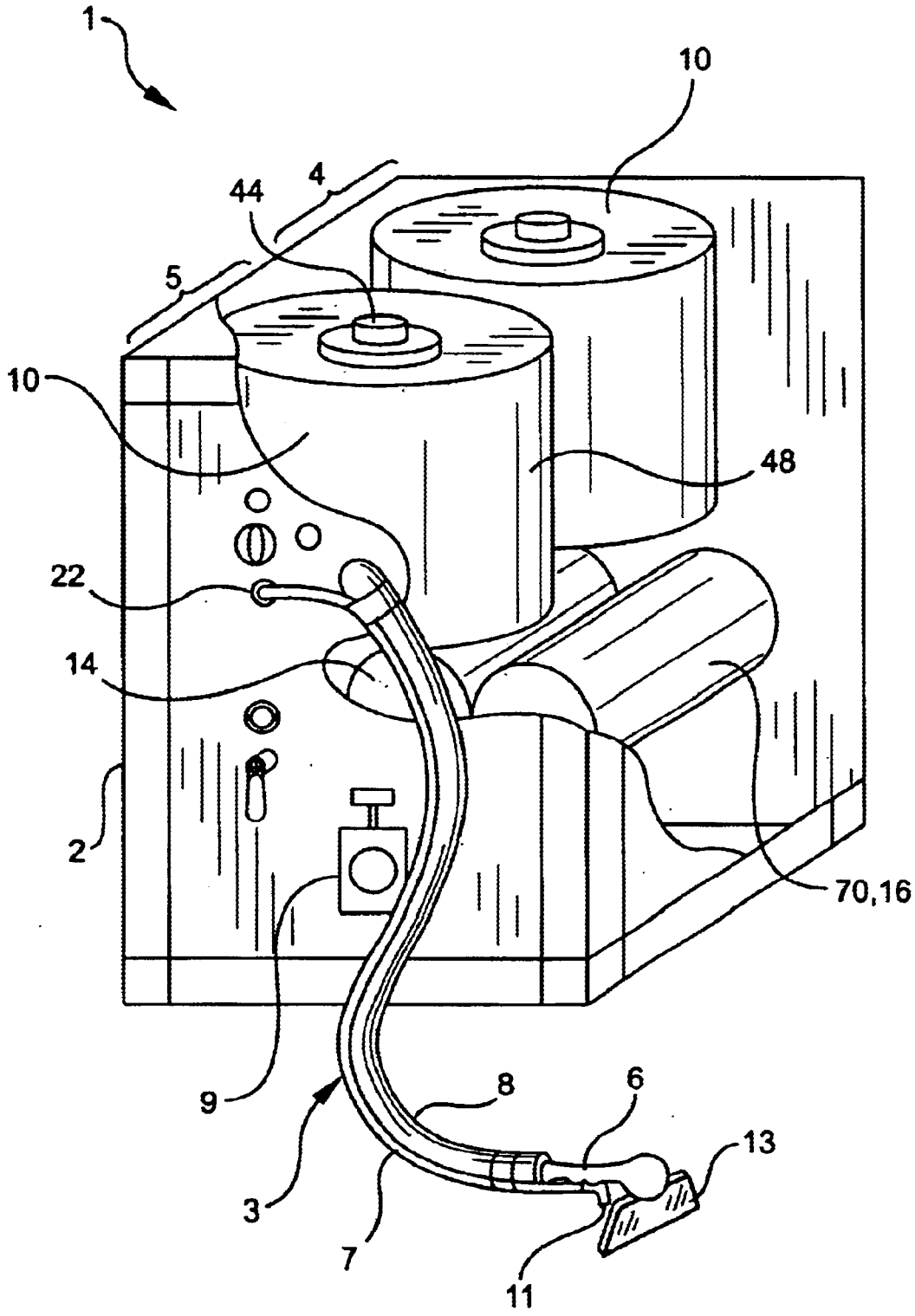
FIG. 1 is a perspective view of the cleaning apparatus of the present invention.

Referring now to the drawings, FIG. 1 generally shows the cleaning apparatus 1 of the present invention. The apparatus generally includes a housing 2 containing an atomizer unit 4 for transforming a cleaning solution into an atomized mist. The apparatus 1 further preferably includes a vacuum unit 5 for removing the cleaning solution from an object surface (not shown) and a nozzle 6 for delivering the mist to the object surface to be cleaned. The atomizer unit 4 and the vacuum unit 5 are contained in the housing 2, while the nozzle 6 extends externally from the housing via a hose 3. The housing further preferably includes a dump valve 9 for emptying used liquid materials from the housing.

The object surfaces capable of being cleaned and disinfected by the present apparatus are walls, floors, carpets, wallpaper, manufacturing equipment, and the like. The cleaning solution used can be any chosen solution for cleaning an object surface. Typically, the cleaning solution will be chosen based upon the surface to be cleaned. For example, if the surface to be cleaned is a hardwood floor, the cleaning solution used would be one formulated to clean that surface without any adverse effects. Cleaning solutions chosen may be water, a disinfectant solution, or any other desired cleaning solution. Preferably, the cleaning solution is housed in an accessible holding tank 10 contained within the housing 2 of the cleaning apparatus 1.

Figure 2:
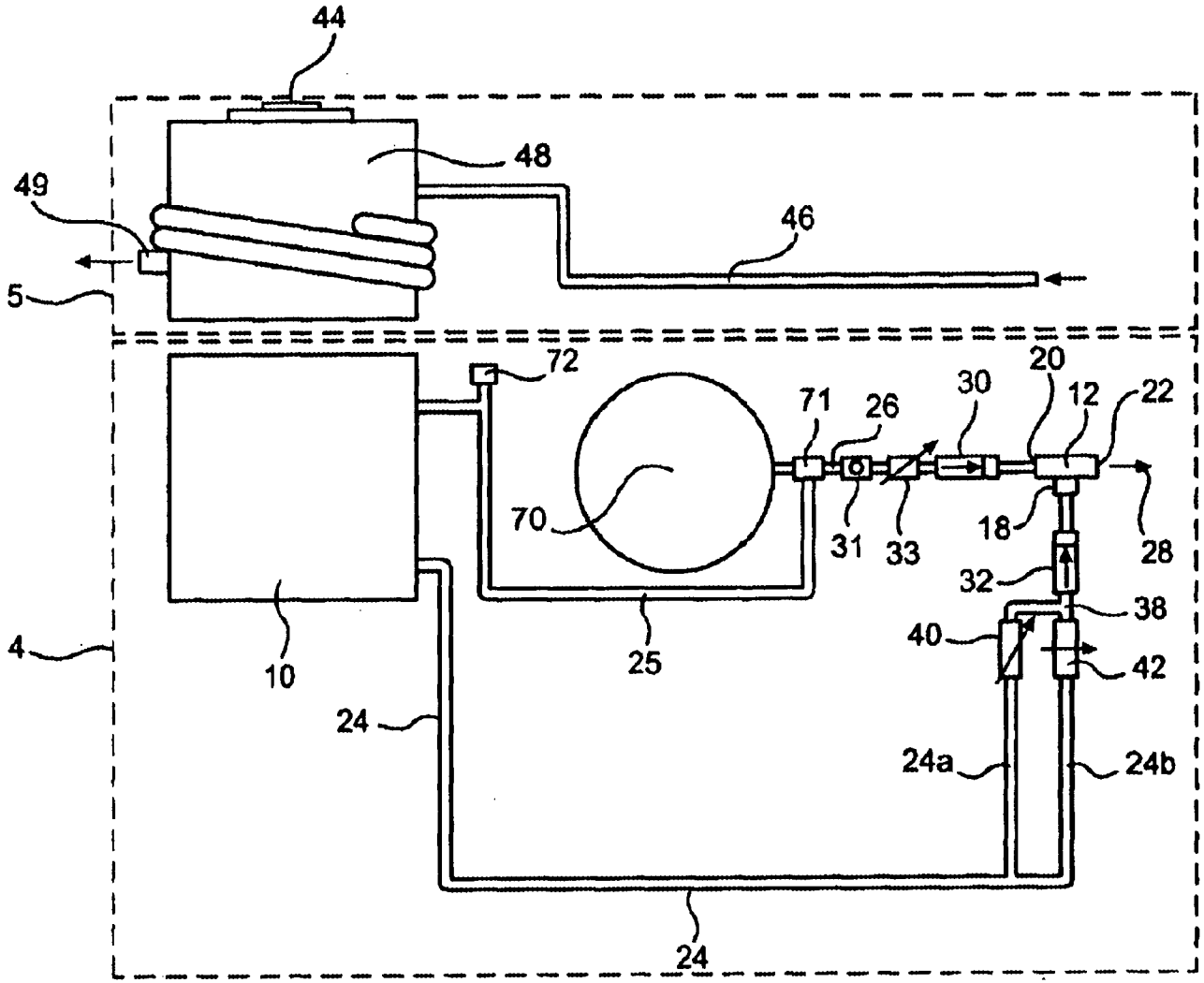
FIG. 2 is a block diagram of the preferred embodiment of the cleaning apparatus detailing its components.

Referring additionally to FIG. 2, the atomizer unit 4 generally includes a junction 12 and a compressor 70. The junction 12 includes at least a first inlet 18, a second inlet 20 and an outlet 22. Preferably, the junction 12 is a mixing valve that enables the atomization of the cleaning solution. The atomization of the cleaning solution disperses the cleaning solution into minute particles by introducing a significant amount of air in combination with the cleaning solution thereby creating a fast drying mixture.

The compressor 70 is arranged in fluid communication with the second inlet 20 of the junction 12. The compressor 70 supplies compressed air to the second inlet 20 of the junction 12. Preferably, the compressor 70 is attached to the second inlet 20 via an air conduit 26. The air conduit 26 preferably includes a check valve 30, a pressure adjustment valve 31 and an adjustable flow valve 33 disposed between the compressor 70 and the junction 12.

The air conduit 26 further includes a diverter fitting 71 to divert a portion of the compressed air stream to the holding tank 10 through a diverter conduit 25. The compressed air supplied to the holding tank 10 by the compressor 70 creates a positive pressure within the tank, thereby forcing the cleaning solution out of the tank into a cleaning solution supply conduit 24. Thus, the compressor 70 is utilized to both drive the cleaning solution from the holding tank 10 and to atomize the cleaning solution and deliver it to the object surface to be cleaned. The conduit 25 connecting the compressor 70 and the holding tank 10 preferably includes a pressure relief valve 72, such as a solenoid valve, to release pressure from the tank 10 if a build up occurs.

The holding tank 10 is connected to the junction 12 via the cleaning solution supply conduit 24. Preferably, and as shown in FIG. 2, the supply conduit 24 is provided with a check valve 32 at a location proximal to the first inlet 18 of the junction 12. Each check valve 30 and 32 of the respective conduits 26 and 24 serves to prevent the back-flow of air or cleaning solution within each conduit. Further, in the preferred embodiment, the cleaning solution supply conduit 24 is divided into two separate conduits **24*a* and 24*b* and then rejoined into a single conduit at a T-fitting 38 before connection to the first inlet 18 of the junction 12. Conduit 24*a* is fitted with an adjustable restrictor valve 40, and conduit 24*b* is fitted with an on/off valve 42. Adjustable restrictor valve 40 can be adjustable valve that permits the regulation of fluid flow therethrough, such as a flow regulator. On/off valve 42** is preferably a standard valve having two stages of operation, on or off, such as a ball valve, a gate valve, or the like.

Conduits **24*a* and 24*b*, along with restrictor valve 40 and on/off valve 42, cooperate to supply a desired amount of cleaning solution to the first inlet 18. For example, when on/off valve 42 is placed in the off position, the flow of cleaning solution delivered from the tank 10 will be directed through conduit 24*a* and through restrictor valve 40 which will allow an amount of cleaning solution to pass therethrough at the flow rate set on the restrictor valve 40. Then, the restricted flow of cleaning solution will be delivered to the first inlet 18 of the junction wherein it will be mixed with compressed air and atomized to form a mist. Depending on the setting of the restrictor valve 40, the atomized cleaning solution will have a high volume of cleaning solution or a low volume of cleaning solution. Preferably, the restrictor valve 40 is adapted to adjust the flow of cleaning solution delivered from the tank 10** from about 0.015 gallons per minute to about 5 gallons per minute.

Further, if the on/off valve 42 is placed in the on position, the flow of cleaning solution will be directed through conduit **24*b* and on/off valve 42. This setting will typically allow for a "full-flow" operation of the cleaning apparatus. In other words, when the on/off valve is set to the on position, the maximun amount of cleaning solution capable of being delivered will be supplied to the first inlet 18. When the on/off valve is set to the off position, the amount of cleaning solution delivered to the first inlet will be regulated by the restrictor valve 40. Since the flow of cleaning solution will follow the path of least resistance to the first inlet 18, the above arrangement allows the operator of the cleaning apparatus to easily switch from a regulated flow of cleaning solution to a "full-flow" of cleaning solution without the need to adjust the restrictor valve 40** every time. As will be readily apparent, the amount of cleaning solution within the atomized mixture will determine the relative drying time after delivery to the object surface.

The cleaning solution and the compressed air are combined at the junction 12 so as to atomize the cleaning solution and transform it into a mist. Thereafter, the atomized cleaning solution 28 is discharged from the outlet 22 of the junction 12 through the nozzle 6 and onto the object surface (not shown) to be cleaned. Since the cleaning solution is atomized, it is relatively quick to dry after application to the object surface.

The operator of the cleaning apparatus, depending upon the cleaning to be performed, may choose to simply cover the object surface with the atomized cleaning solution and perform no further operations. This may be useful when the cleaning solution intended to be delivered to the object surface is to remain without being removed, such as with a disinfectant. However, if the atomized cleaning solution delivered to the object surface is to be removed therefrom, the cleaning apparatus is further preferably provided with a vacuum unit 5, which will remove the cleaning solution.

As shown in FIGS. 1 and 2, the vacuum unit 5 includes a vacuum pump 44, which produces a suction capable of removing the cleaning solution from the object surface. The vacuum pump 44 is attached to a vacuum conduit 46, which directs the flow of cleaning solution being removed to a waste tank 48. The operation and components which comprise a vacuum are known in the art and need not be described in detail herein. However, it is preferred that the exhaust 49 for the vacuum unit 5 is arranged in such a manner that it wraps around the waste tank 48 before exiting the housing 2. This particular arrangement assists in keeping the noise emitted by the vacuum motor to a minimum during use. This is especially useful when quiet operation is desired, such as within a hospital or nursing home environment.

Preferably, and as shown in FIG. 1, the vacuum unit 5 is housed within the same housing 2 as the atomizer unit 4, thereby creating a compact and portable cleaning apparatus. With this embodiment, the hose 3 includes first and second conduits 7 and 8 banded together and the nozzle 6 has a first and second port 11 and 13 in respective fluid communication with the first and second conduits. The first conduit 7 is in fluid communication with the outlet 22 of the junction 12 for discharging the atomized cleaning solution onto the object surface and the second conduit 8 is in fluid communication with the vacuum conduit 46 so as to remove the atomized cleaning solution from the object surface.

However, for larger scale operations, the atomizer unit 4 and the vacuum unit 5 may be arranged, for example, on the rear of a truck. In such an embodiment, the atomizer unit 4 and the vacuum unit 5 will each have their own nozzle for delivery and removal of the atomized cleaning solution.

Figure 3:
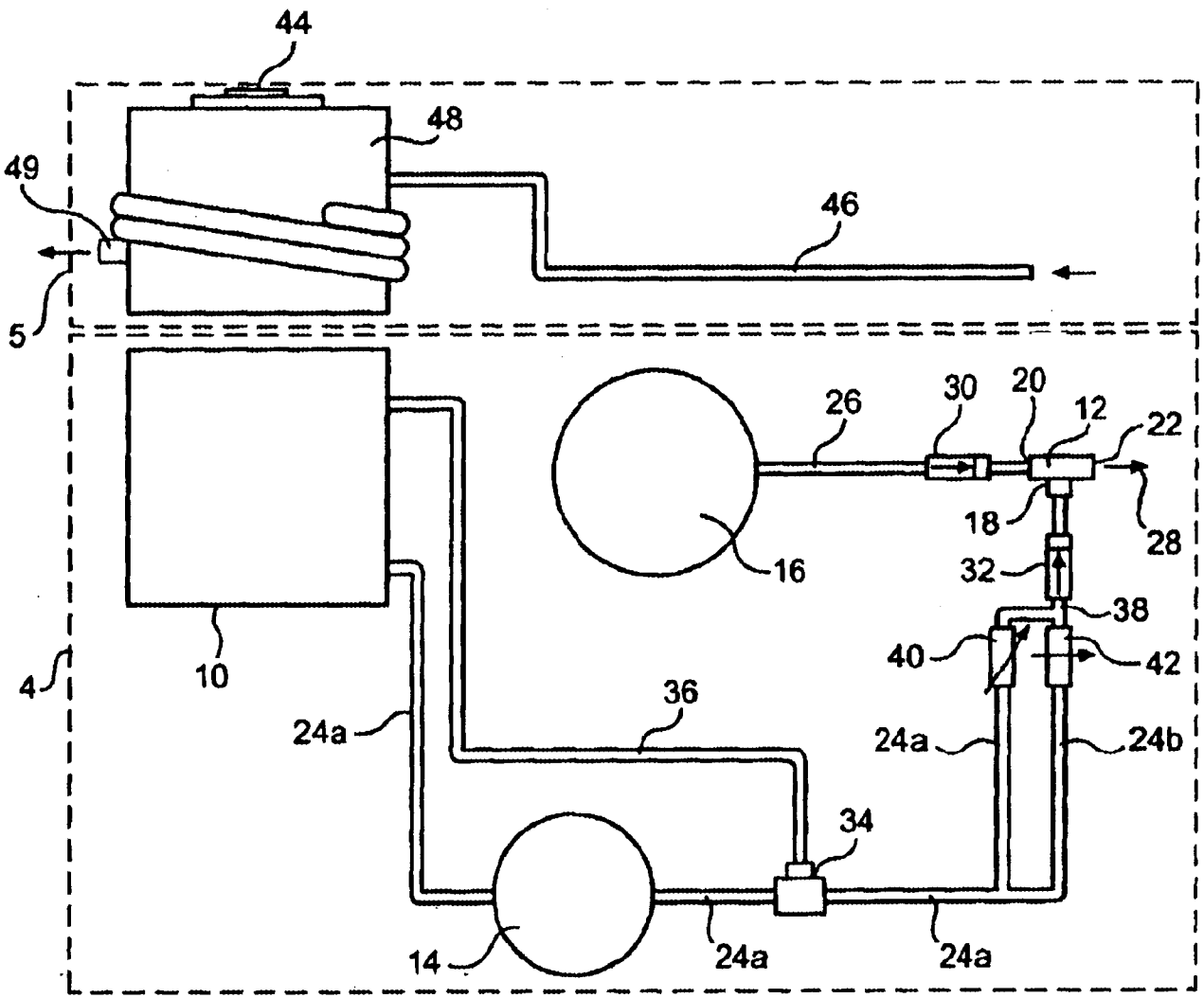
FIG. 3 is a block diagram of an alternative embodiment of the cleaning apparatus of the present invention.

Referring now to FIG. 3, an alternative embodiment of the cleaning apparatus of the present invention is shown. In this embodiment, a pump 14 is utilized to drive the cleaning solution from the holding tank 10 to deliver it to the object surface to be cleaned. As shown in FIG. 3, the compressor 16 of this embodiment is not connected to the holding tank 10. However, most of the remaining components and operation of the system of this alternative embodiment are identical to that described above and, hence, identical reference numerals have been designated in FIG. 3.

The pump 14 is arranged so as to supply the cleaning solution from the holding tank 10 to the first inlet 18 of the junction 12. Preferably, and as shown in FIG. 3, the pump 14 is in fluid communication with the first inlet 18 and the holding tank 10 via a cleaning solution supply conduit 24*a*. Preferably, the supply conduit 24*a* is a hose, tube, or any other channel through which the pump 14 may supply the cleaning solution. Further, the supply conduit 24*a* is also preferably provided with a relief valve 34 located between the pump 14 and the first inlet 18, and preferably between the pump 14 and the check valve 32. The relief valve 34 is, in turn, connected to the holding tank 10 by a relief conduit 36 through which any cleaning solution may be returned to the holding tank 10 in the event of pressure increase and the resultant actuation of the relief valve 34.

Figure 4:
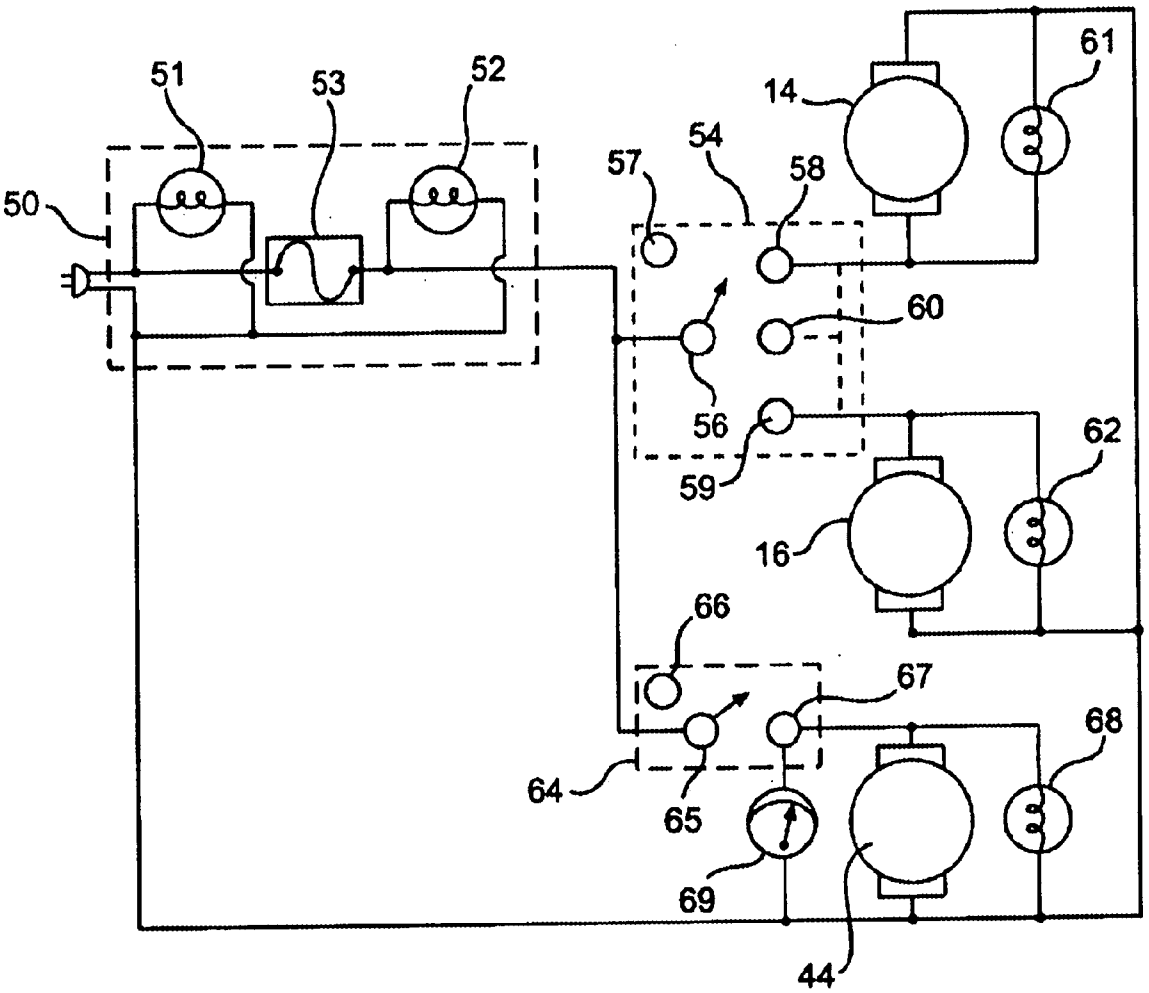
FIG. 4 is a schematic diagram of the electrical layout and switching relay of the present invention.

Referring now to FIG. 4, the preferred electrical layout and switching arrangements of the present cleaning apparatus are shown. In the embodiment shown, the cleaning apparatus is configured for use with an AC power source. It will, however, be apparent to one skilled in the art how to modify the present layout to enable operation with a DC power source.

When connected to a power source, electrical current first powers a power indicator arrangement 50. The power indicator arrangement 50 includes a first indicator light 51, a second indicator light 52 and a fuse 53. Each indicator light 51 and 52 is preferably positioned at the front and rear, respectively, of the cleaning apparatus. This arrangement allows the operator of the cleaning apparatus to determine, from either side, when power is supplied to the unit. In the event of a power surge, the fuse 53 will trip and interrupt power to the remainder of the cleaning apparatus components and indicator lights 51 and 52, thereby indicating a power problem to the operator.

Further, the cleaning apparatus is also provided with a fan (not shown) which is contained within the housing. The fan is arranged so as to be in constant operation whenever power is supplied to the apparatus. The fan assists in cooling the pump(s), compressor and vacuum contained within the housing. Further, when the fuse 53 trips, power to the fan is also disabled.

The electrical circuit is next provided with a first switching arrangement 54. The first switching arrangement 54 is preferably a multi-position switch. The first switching arrangement 54 provides power to the pump 14 (if used), the compressor 70, 16, or both the pump and the compressor. The operator can either select to position the switch 56 to be in the off position 57, the pump only position 58, the compressor only position 59, or the pump/compressor position 60. By providing this switching arrangement, an operator can choose to pump the cleaning solution only through the junction, provide compressed air only through the junction, or provide both the compressed air and cleaning solution to the junction for atomization of the cleaning solution as described above. When power is provided to the pump 14 and/or the compressor 70, 16, power lights 61 and 62, respectively, are illuminated thereby indicating to the operator that power is supplied to these components.

Additionally, a second switching arrangement 64 is provided for delivering power to the vacuum pump 44. The operator can select to position the switch 65 in either the off position 66 or the on position 67. When power is provided to the vacuum pump 44, power light 68 is illuminated to indicate to the operator that power is supplied to the vacuum. Further, the cleaning apparatus is provided with an hour meter 69. The hour meter 69 indicates operational time of the cleaning apparatus such that the scheduling of routine maintenance can be efficiently and easily tracked.

It will be readily apparent to one skilled in the art that the above-described electrical layout, switching arrangement and component selection can be varied. For example, the pump and the compressor can each be provided with their own separate switch, as opposed to the multi-position switch described above.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. An apparatus for cleaning an object surface comprising:

a junction having at least a first inlet, a second inlet and an outlet;

a holding tank for containing a cleaning solution therein, said holding tank being in fluid communication with said first inlet of said junction; and a compressor in fluid communication with said holding tank and said second inlet of said junction, said compressor arranged to supply an amount of compressed air to said holding tank to create a positive pressure in said tank thereby forcing an amount of cleaning solution out of said tank at a rate of about 0.015 gallons per minute into said first inlet of said junction and to supply an amount of compressed air to said second inlet of said junction where it is combined with said cleaning solution supplied at said first inlet of said junction to produce a vapor discharged from said outlet of said junction.

2. The apparatus as defined by claim 1, further comprising a vacuum unit producing a suction at said junction outlet.

3. The apparatus as defined by claim 1, further comprising a restrictor valve for adjusting the amount of cleaning solution supplied by said holding tank to said first inlet of said junction.

4. The apparatus as defined in claim 1, further comprising:

a nozzle in fluid communication with said outlet of said junction for discharging said cleaning solution vapor onto the object surface to be cleaned.

5. The apparatus as defined in claim 2, further comprising:

a nozzle in fluid communication with said outlet of said junction for discharging said cleaning solution vapor onto the object surface to be cleaned.

6. The apparatus as defined in claim 5, wherein said nozzle is in fluid communication with said vacuum unit so as to remove said cleaning solution vapor from the object surface.

7. The apparatus as defined in claim 6, wherein said nozzle includes a first port in fluid communication with said outlet of said junction for discharging said cleaning solution vapor and a second port in fluid communication with said vacuum unit for removal of said discharged cleaning solution vapor by said vacuum unit.

8. An apparatus for cleaning an object surface comprising:

a junction having at least a first inlet, a second inlet and an outlet;

a pump, said pump arranged to supply cleaning solution at a rate of about 0.015 gallons per minute to said first inlet of said junction; and a compressor, said compressor supplying compressed air to said second inlet of said junction;

wherein said cleaning solution and said compressed air are combined so as to produce a cleaning solution vapor from said cleaning solution and discharge said cleaning solution vapor from said outlet of said junction onto the object surface to be cleaned.

9. The apparatus as defined in claim 8, further comprising:

a vacuum unit producing a suction, at said junction outlet for removing said discharged cleaning solution vapor from the object surface.

10. The apparatus as defined in claim 8, further comprising a restrictor valve for adjusting the amount of cleaning solution supplied by said pump so as to produce the cleaning solution vapor.

11. The apparatus as defined in claim 8, further comprising:

a nozzle in fluid communication with said outlet of said junction for discharging said cleaning solution vapor onto the object surface to be cleaned.

12. The apparatus as defined in claim 9, further comprising:

a nozzle in fluid communication with said outlet of said junction for discharging said cleaning solution vapor onto the object surface to be cleaned.

13. The apparatus as defined in claim 12, wherein said nozzle is in fluid communication with said vacuum unit so as to remove said cleaning solution vapor from the object surface.

14. The apparatus as defined in claim 13, wherein said nozzle includes a first port in fluid communication with said outlet of said junction for discharging said cleaning solution vapor and a second port in fluid communication with said vacuum unit for removal of said discharged cleaning solution vapor by said vacuum unit.

15. An apparatus for cleaning an object surface comprising:

a housing;

a junction having an outlet;

a holding tank for a cleaning solution, said holding tank mounted within said housing;

a pump mounted within said housing, wherein said pump is in fluid communication with said holding tank and said junction, and is arranged so as to deliver an amount of said cleaning solution at a rate of about 0.015 gallons per minute from said holding tank to said junction;

a compressor mounted within said housing, wherein said compressor is in fluid communication with said junction and is arranged so as to deliver compressed air to said junction, wherein said compressed air and said cleaning solution are combined at said junction so as to produce a cleaning solution vapor from said cleaning solution;

a nozzle in fluid communication with said junction outlet, said nozzle delivering said cleaning solution vapor to the object surface to be cleaned;

a vacuum pump mounted within said housing and in fluid communication with said nozzle, said vacuum pump providing a suction for removing said delivered cleaning solution vapor from the object surface to said vacuum pump; and a waste tank mounted within said housing and in fluid communication with said vacuum pump, said waste tank receiving said removed cleaning solution vapor from said vacuum pump.

16. The apparatus as defined in claim 15, further comprising a restrictor valve for adjusting the amount of cleaning solution delivered by said pump so as to produce the cleaning solution vapor.

17. The apparatus as defined in claim 15, wherein said nozzle includes a first port in fluid communication with said outlet of said junction for discharging said cleaning solution vapor and a second port in fluid communication with said vacuum pump for removal of said discharged cleaning solution vapor by said vacuum pump.

* * * * *